US005415484A

United States Patent [19]

Gallagher et al.

[11] Patent Number: 5,415,484

[45] Date of Patent: May 16, 1995

[54] METHOD AND APPARATUS FOR CUTTING MAILING MACHINE ROLL TAPE

[75] Inventors: Dennis M. Gallagher, Danbury; John R. Nobile, Fairfield; Thomas M. Pfeifer, Bridgeport; William A. Ross, Darien; Richard P. Schoonmaker, Wilton, all of Conn.

[73] Assignee: Pitney Bowes Inc., Stamford, Conn.

[21] Appl. No.: 203,460

[22] Filed: Feb. 28, 1994

[51] Int. Cl.[6] ..... B41J 11/70

[52] U.S. Cl. ..... 400/621; 400/708

[58] Field of Search ..... 400/61, 64, 621, 708; 101/91, 226, 227; 226/143

[56] References Cited

U.S. PATENT DOCUMENTS

| | | | |
|---|---|---|---|
| 4,560,990 | 12/1985 | Sue et al. | 400/621 |
| 4,568,950 | 2/1986 | Ross et al. | 400/621 |
| 4,925,325 | 5/1990 | Niikawa | 400/621 |
| 4,981,059 | 1/1991 | Kobayashi | 400/621 |
| 5,131,772 | 7/1992 | Yamaguchi | 400/621 |
| 5,222,818 | 6/1993 | Akiyama et al. | 400/621 |

*Primary Examiner*—Ren Yan

*Attorney, Agent, or Firm*—Melvin J. Scolnick; David E. Pitchenik; Steven J. Shapiro

[57] ABSTRACT

A mailing machine for printing a postage indicia with or without an advertisement on envelopes and varying lengths of postage tape. Also, a method of feeding, printing and cutting postage tape in a mailing machine. The mailing machine includes: an elongate feed deck; a postage meter mounted in the mailing machine and having a printer downstream of the feed deck for printing a postage indicia with or without an advertisement on successive envelopes as they are fed along the feed deck or on postage tape; and a tape feeding and cutting apparatus mounted in the mailing machine for feeding postage tape to the postage meter for printing of the postage indicia with or without advertisement and for cutting the postage tape into finite lengths and ejecting the lengths of tape from the mailing machine. The cut, printed portion includes only the amount of tape necessary for the printing of the indicia with or without advertisement regardless of the length of any advertisement printed.

8 Claims, 10 Drawing Sheets

TAPE CYCLE - NO AD PLATE

TAPE CYCLE - WITH AD PLATE

METHOD AND APPARATUS FOR CUTTING MAILING MACHINE ROLL TAPE

BACKGROUND OF THE INVENTION

The instant invention relates generally to mailing machines having a postage meter which prints, postage indicia on tape, and particularly to such a mailing machine in which the postage meter also prints advertisements using ad plates having different lengths.

Prior art mailing machine have long been well known and widely accepted in all forms of commercial establishments from the largest of high volume mailers down to the smallest size businesses and professional offices. Broadly speaking, a mailing machine consists of a postage meter which prints postage indicia on an envelope or a strip of tape, and a feed base for feeding successive envelopes or a strip of tape past the postage meter, and ejecting either for further handling. Mailing machines have been available in a variety of sizes in terms of rate of operation and level of technical sophistication and automation. Thus, for example, a machine found in the mailing room of a high-volume mailer such as a credit card billing office might process several thousand envelopes per hour, with automatic feeding, flap moistening, sealing and stacking. Similarly, a machine found in a small, professional office might require manually feeding one envelope at a time into the feed base and do nothing more than print the postage indicia on the envelope and eject it.

Obviously, there are many variations between the extremes described above, and a large variety of machines have been designed and marketed to meet the mailing requirements of establishments whose mailing volume falls between these extremes. One important characteristic of machines falling in this category is that they have the capability of printing postage indicia either directly on envelopes as they are fed along a feed path through the mailing machine, or on a strip of tape, either gummed or adhesive backed, which is dispensed from the mailing machine for an operator to apply to an envelope which cannot be fed along the normal feed path to the printing device. This is a feature normally not incorporated into the smallest of mailing machines for the reason that the cost of infrequently used tape feeding mechanisms would not be attractive to such low volume mailers.

Thus, the bulk of the development of tape feed mechanisms for mailing machines has been in the mid-range size, and particularly in machines in which it is anticipated that the user not only generates a fairly large volume of regular mail which can be automatically fed through the mailing machine, but also a substantial amount of mail which is either too large or bulky to be fed through the mailing machine and therefore must have postage applied manually, either in the form of stamps or postage indicia printed on tape. Assuming that the user wishes to avoid the use of stamps, it becomes highly advantageous to incorporate a functionally efficient and cost effective tape handling mechanism into the mailing machine.

In many cases the printing die of the postage meter includes not only the die to print the postage indicia but also a die that will print an ad adjacent the postage indicia. The size, i.e. the length, of the ad will vary from ad to ad, and thus the amount of space needed on a section of postage tape will vary. Clearly, if the space required for the ad is significantly less than the length of the postage tape, there is a wasting of postage tape since a significant amount will be blank. In mailing machine tape feed mechanisms employed today, either the length of the tape sections is fixed, resulting in considerable wasting of tape, or the operator selects a length of tape before printing, which is clumsy. Moreover, in either case, the tape feed mechanism is unable to consistently monitor the presence of the lead edge of tape, so that appropriate cutting of the tape is not possible on a consistent basis.

The instant invention therefore provides a functionally efficient tape feed mechanism for a mailing machine which determines the length of the printed indicia and any accompanying ad and then cuts the appropriate length of tape consistent with the printed indicia and any accompanying ad so that no more tape than is necessary is used.

SUMMARY OF THE INVENTION

Accordingly, the instant invention provides a mailing machine for printing a postage indicia with or without an advertisement on envelopes and varying lengths of postage tape. The mailing machine includes: an elongate feed deck; a postage meter mounted in the mailing machine and having a printer downstream of the feed deck for printing a postage indicia with or without an advertisement on successive envelopes as they are fed along the feed deck or on postage tape; and a tape feeding and cutting apparatus mounted in the mailing machine for feeding postage tape to the postage meter for printing of the postage indicia with or without advertisement and for cutting the postage tape into finite lengths and ejecting the lengths of tape from the mailing machine. The tape feeding and cutting apparatus includes: means for storing a supply roll of tape of indefinite length; means for feeding tape from the tape supply roll to the postage meter printer for printing of the postage indicia with or without advertisement on a portion of the tape; means for sensing when the postage meter printer has completed printing the postage indicia with or without advertisement; means for retracting an amount of tape from the postage meter as determined by the sensing means which will result in an appropriate, finite length of tape being cut by the tape feeding and cutting apparatus; means for cutting the printed portion of the tape from the roll of tape; and means for ejecting the cut, printed portion of tape from the mailing machine, whereby the cut, printed portion of tape includes only the amount of tape necessary for the printing of the indicia with or without advertisement regardless of the length of any advertisement printed.

The instant invention also provides a method of feeding, printing and cutting postage tape in a mailing machine. The method comprises: feeding postage tape along a first path toward a postage meter; printing postage indicia with or without an advertisement on a portion of said tape; sensing when the printing of the indicia with or without advertisement has been completed; retracting an amount of tape from the postage meter based upon the sensing of the completion of the printing; cutting an appropriate, finite length of printed tape; and ejecting the finite length of cut, printed tape from the mailing machine, whereby said finite length of cut, printed tape includes only the amount of tape necessary for the printing of said indicia with or without advertisement regardless of the length of any advertisement printed.

FIGS. *7a* and *7b* comprise a flow chart of the operation of the routine for control of tape length in accordance with the invention.

Figure 8:
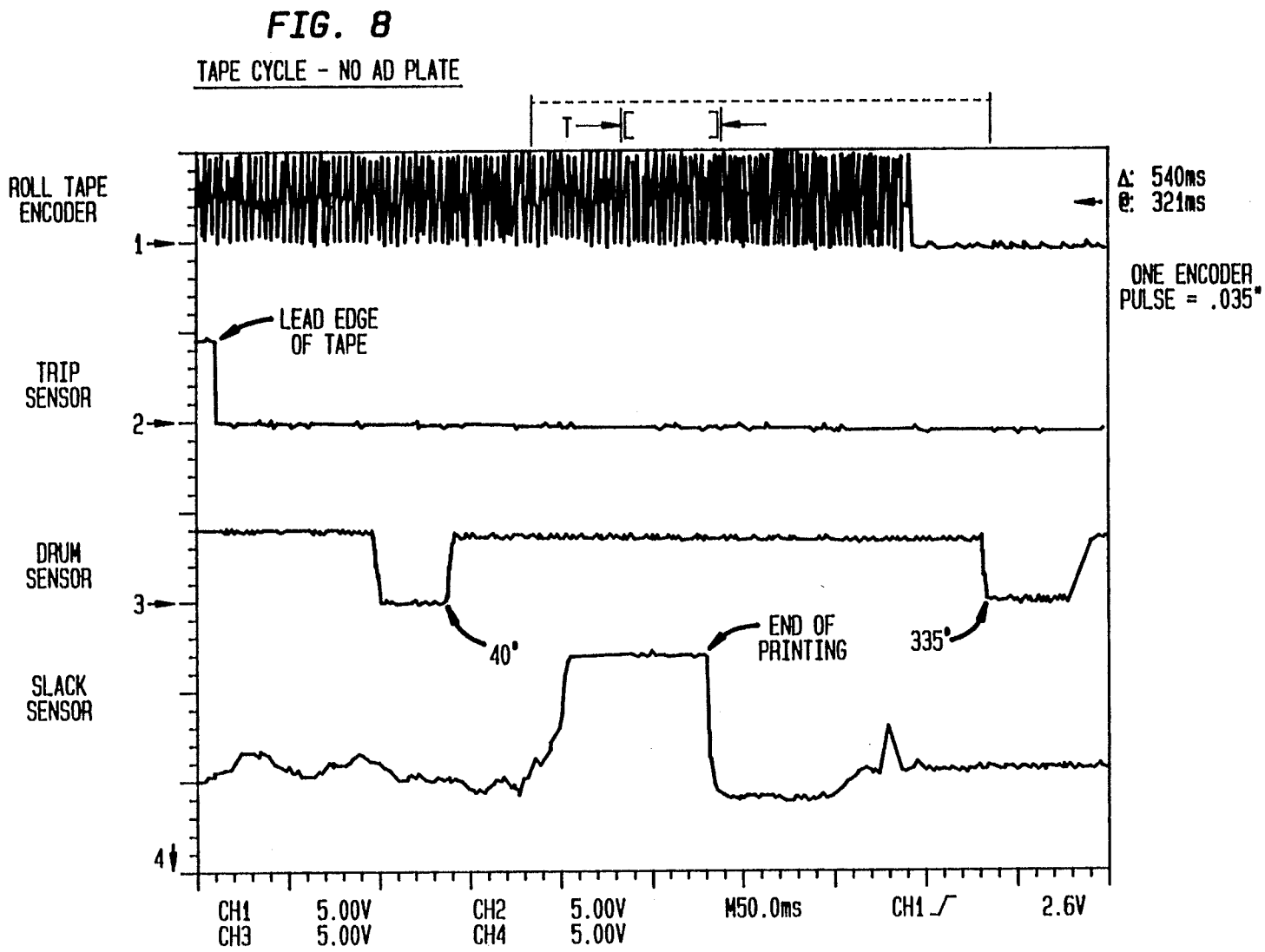
Figure 9:
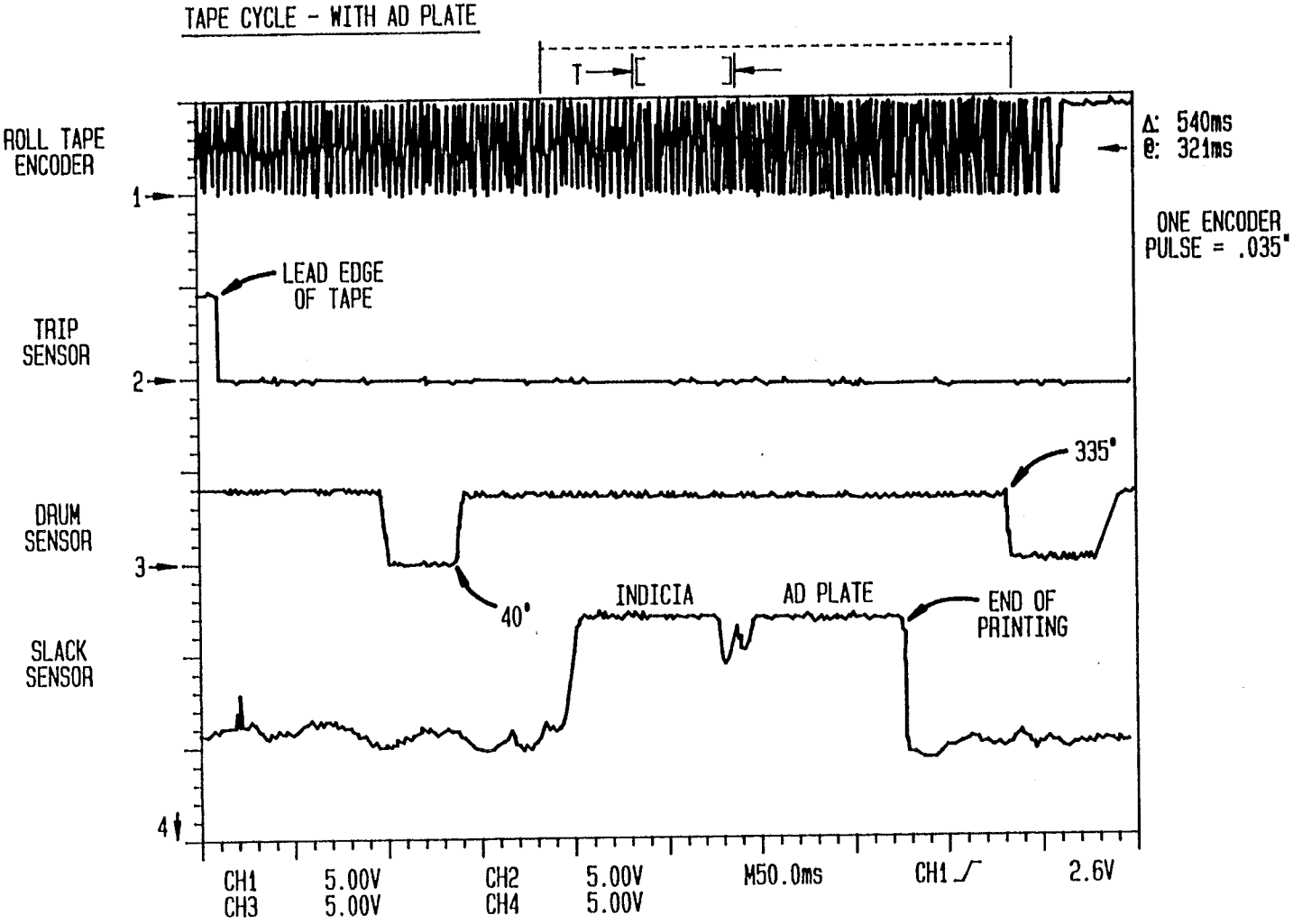

FIG. 8 is a timing plot of the signals showing the timing of a tape cycle without an ad plate being printed FIG. 9 shows the timing with the ad plate printed.

DESCRIPTION OF THE PREFERRED EMBODIMENT

Figure 1:
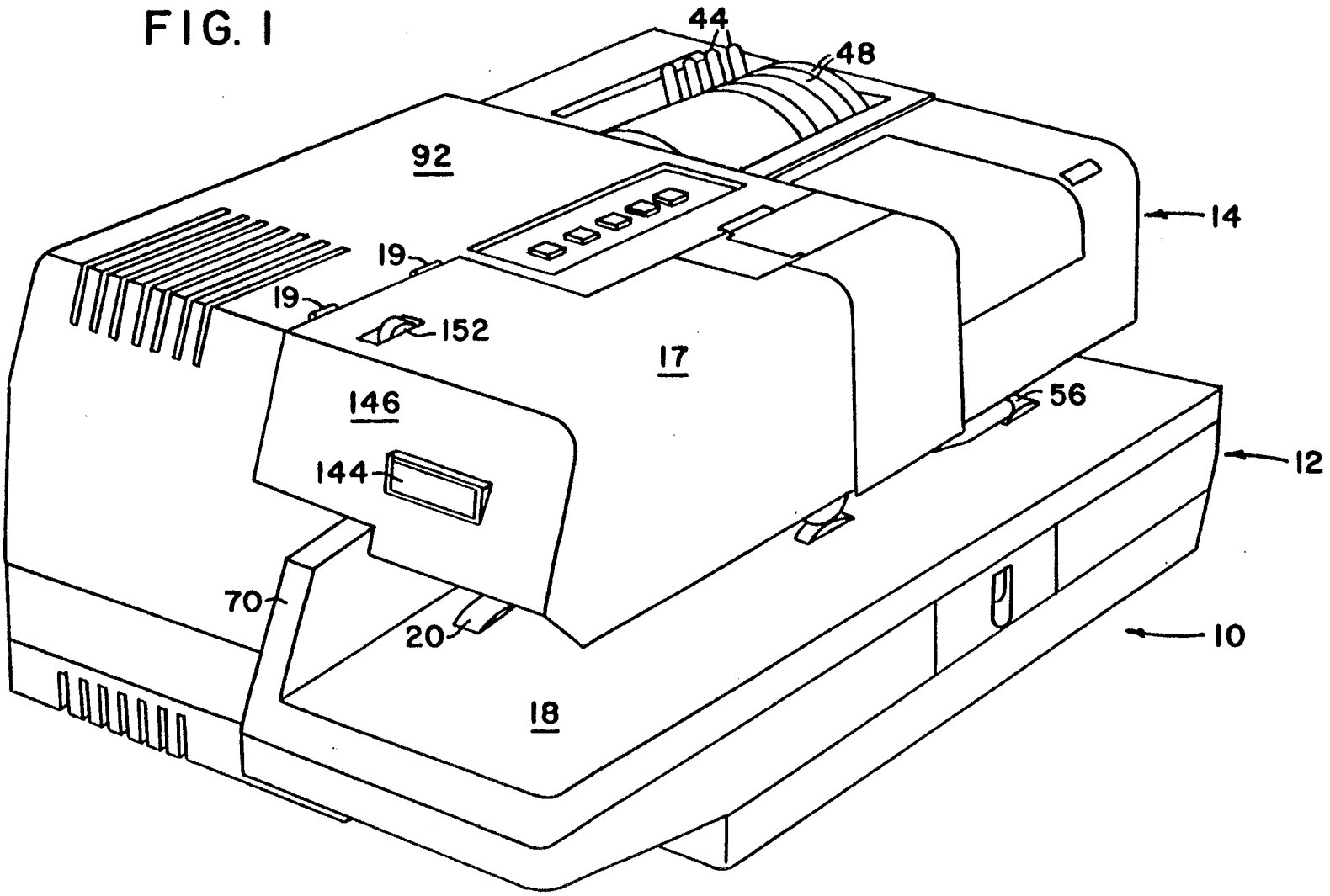
FIG. 1 is a general perspective view of a mailing machine embodying the present invention.
Figure 2:
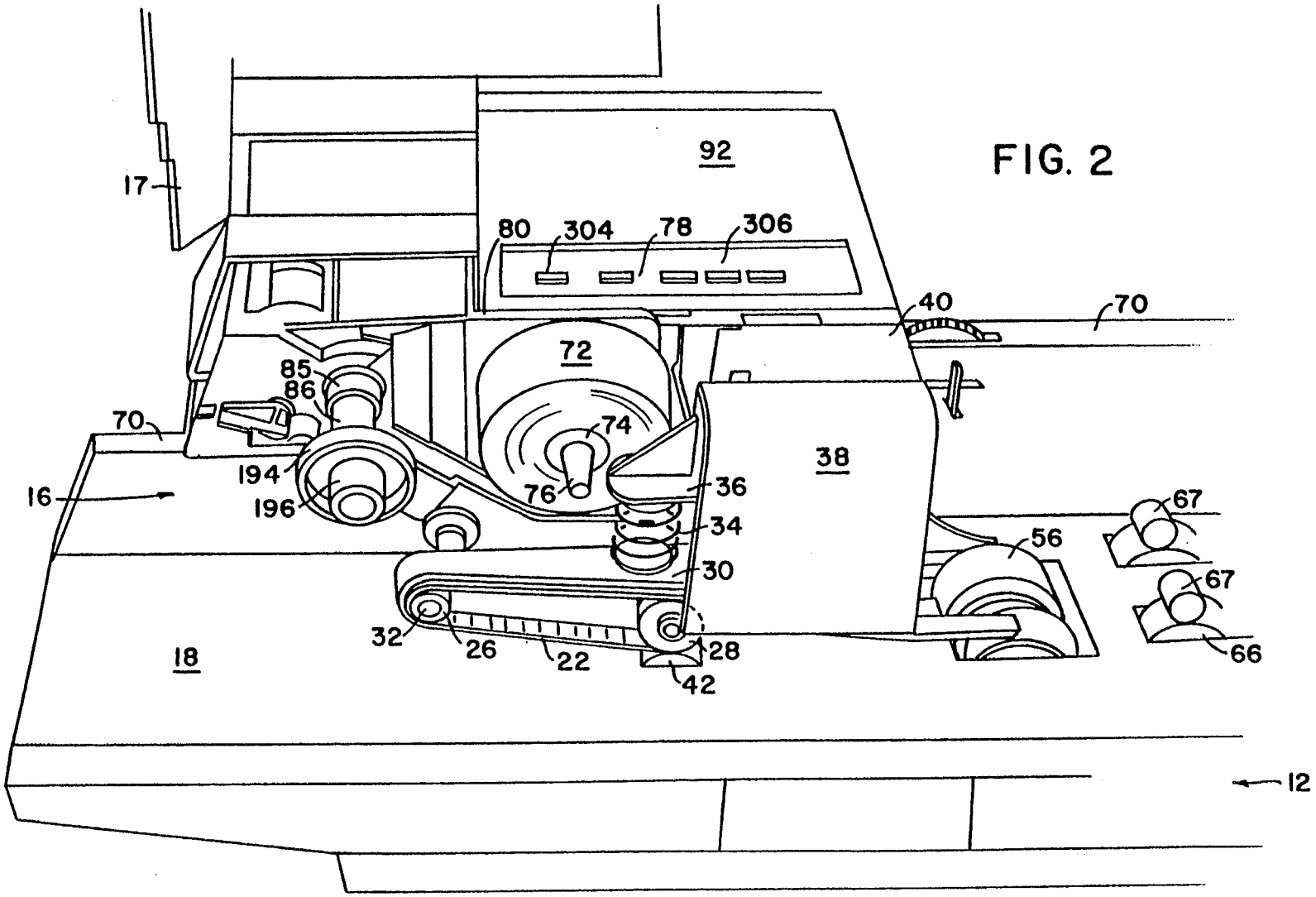
FIG. 2 is a frontal perspective view of the mailing machine shown in FIG. 1 with some covers removed to expose details.

In FIGS. 1 and 2, there is shown generally at 10 a mailing machine as described generally in applications Ser. No. 180,163 for Mailing Machine, Ser. No. 180,161 and Ser. No. 180,168 for Tape Feeding, Cutting and Ejecting Apparatus for a Mailing Machine all filed Jan. 11, 1994, each assigned to the assignee of the present invention and specifically incorporated herein by reference.

The mailing machine includes a base shown generally at 12, a postage meter generally designated at 14, and a tape feeding, cutting, and ejection apparatus shown generally at 16 (FIG. 2). The mailing machine preferably includes a housing having a pivoted cover 17 connected by hinges 19 which can be raised to provide access.

The base 12 comprises a feed deck 18 which extends through the mailing machine 10 for support of mailpieces. Feeding rollers 20 project upward through the deck for engaging the underside of the mailpieces while belt 22 which extends around drive pulley 26 and idler pulley 28 serves to engage the upper surface for transporting the mailpiece for feeding to the postage meter. The outer surface of belt 22 passing around idler pulley 28 is mounted on elongate housing 30 which is pivoted about shaft 32 which drives the pulley 26. Housing 30 is spring loaded downwardly by spring 34 on bracket 36 formed on ink cartridge housing 38 which holds a removable ink cartridge 40. Belt 22 engages an idler roller 42 mounted beneath the feed deck 18 which acts as a pressure backup to ensure proper feeding of mailpieces between the belt 22 and idler roller 42.

Figure 3:
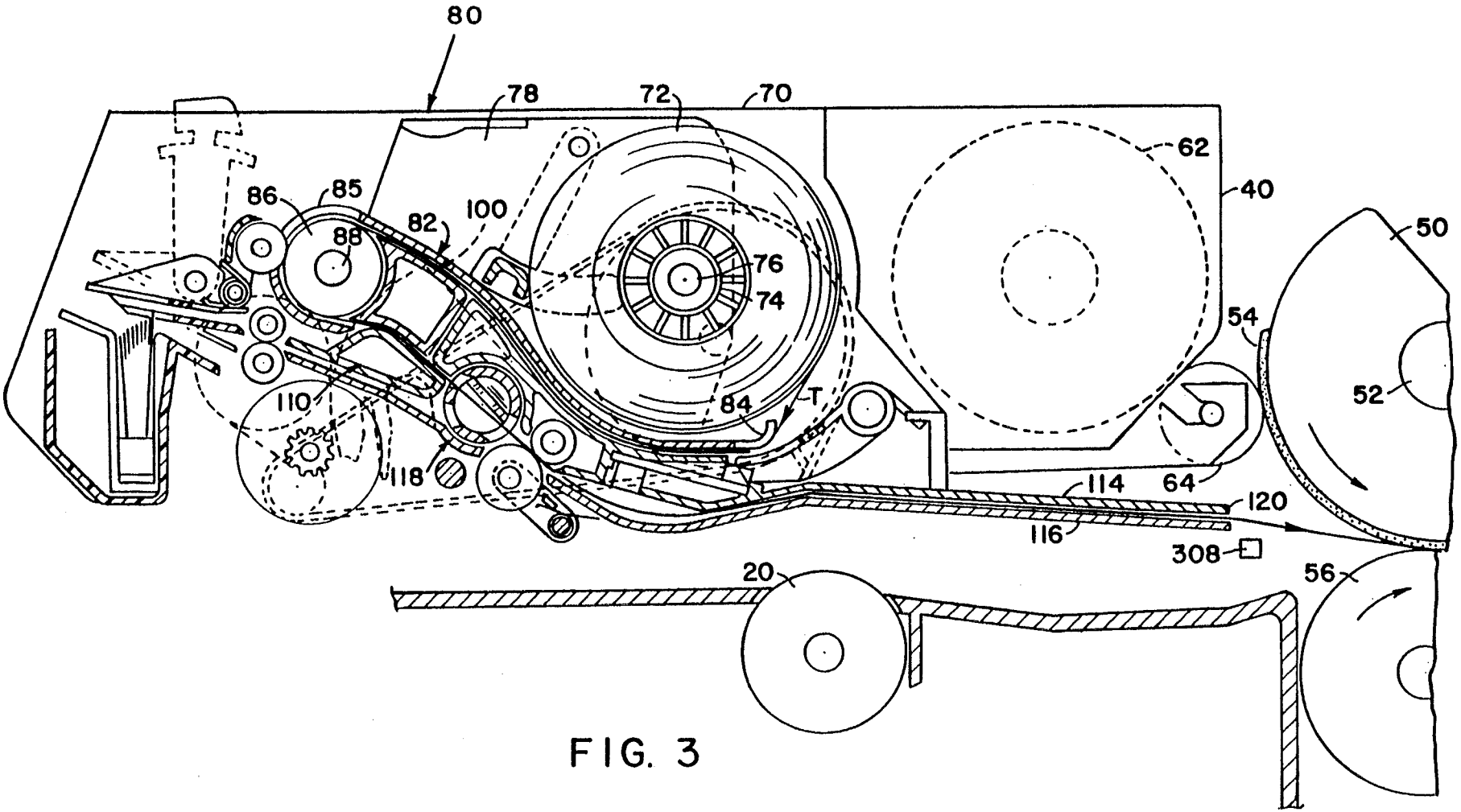
FIG. 3 is a view of the tape feeding, cutting and ejecting apparatus shown in place in the mailing machine.

Postage meter 14 has a plurality of setting levers 44 for setting postage in accordance with numerals on scales 48. As seen in FIG. 3 the postage meter includes print drum 50 mounted on shaft 52 which is driven for rotation of the drum. Drum 50 carries a printing die 54 for printing the indicia on a mailpiece pressed into firm engagement by impression rollers 56. The ink cartridge 40 contacts spring loaded transfer roller 64 for transferring ink to the printing die 54 on each revolution of the printing drum.

Returning to FIG. 2, the base further includes a plurality of eject rollers 66 and cooperating spring loaded pressure rollers 67 for conveying the mailpiece to the end of the feed deck.

Figure 4:
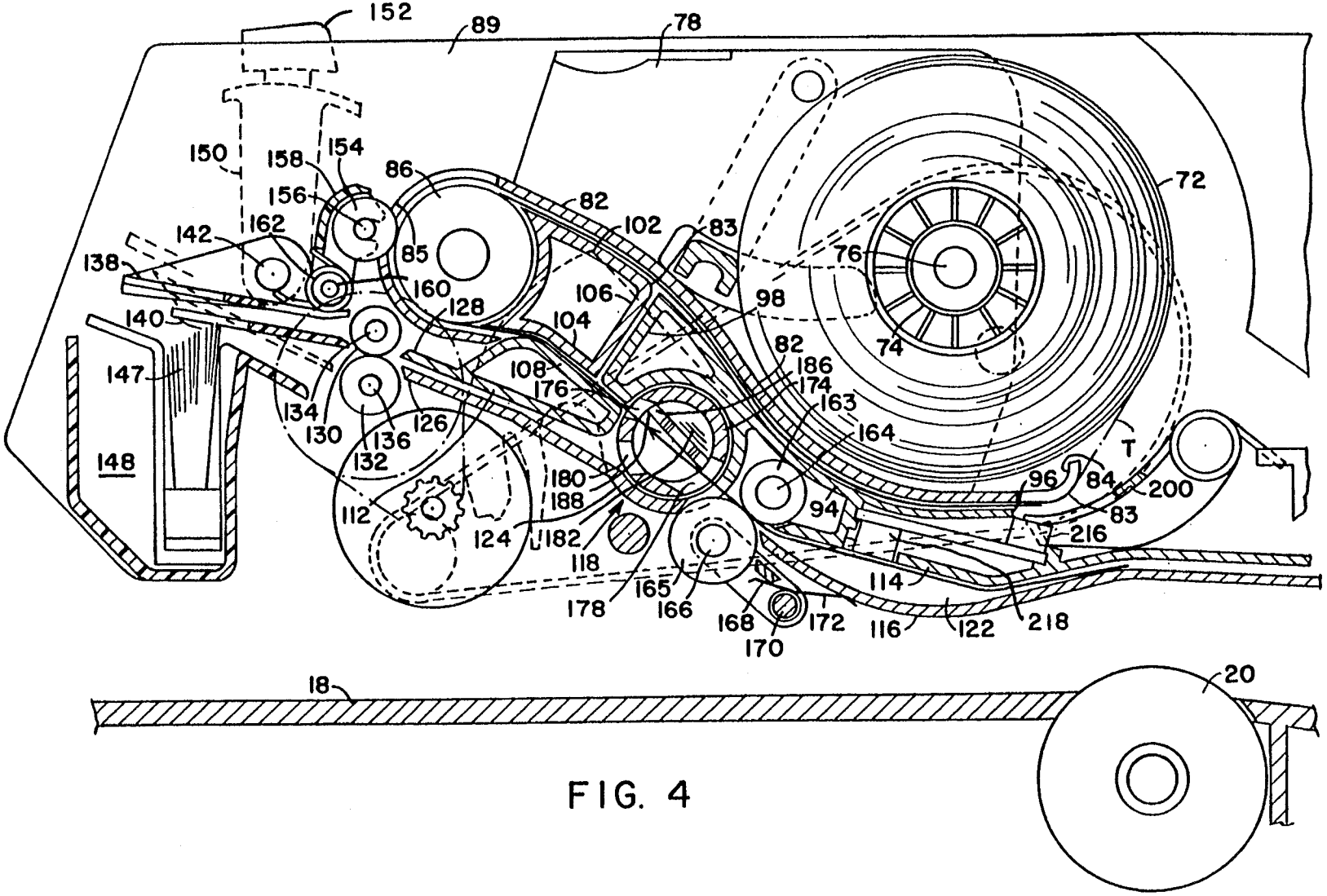
FIG. 4 is a view similar to FIG. 3 but drawn to enlarged scale and partly in longitudinal section to reveal particular details.

Referring now to FIGS. 3 and 4, the base 12 includes a wall 70 (also in FIGS. 1 and 2). The tape feeding, cutting and ejection apparatus 16 is mounted on the wall 70. Apparatus 16 includes a roll of tape 72 suitably mounted on spindle 74 which in turn is mounted on tape holding means which includes stub shaft 76 fixed to an upstanding wall 78 of a movable mounting frame designated generally at 80.

The mounting frame 80 also includes an upper guide plate 82 and has an upturned lip 84 which forms an entrance guide for the strip of tape "T" as it comes off the roll. The upper guide plate terminates in a pair of spaced apart U-shaped portions 85 which fit closely around the outer periphery of a drum shaped tape feed roller 86 fixedly mounted on shaft 88.

As best seen in FIG. 4, the strip is threaded through slot 83 formed formed by the lower surface of the upper guide plate 82 and guide wall 102. The U-shaped portions terminate in a flat portion 87 which is tapered to form a cutting edge 93 against which the free end of tape T is pulled , after it exits through slot 95 defined by edge 93 and guide wall 104. The lower guide plate 94 is disposed contiguously with guide plate 82 over most of its length commencing at end 96 and extending to wall 98.

An upper intermediate guide portion indicated at 100 is arranged in the space between wall 98 and tape feed roller 86 and includes the guide walls 102 and 104 and an upright wall 106 between the walls 102 and 104. The lower guide wall 104 is disposed in close relationship with an upper guide wall 108 of a lower intermediate guide portion designated by 110. This intermediate portion 110 has a lower guide wall 112.

A second set of guide plates 114 and 116 extend generally from a point adjacent a severing mechanism 118 to another point 120 adjacent the nip of the printing drum 50 and the impression roller 56. There is a short span where these guide plates are separated by a substantially larger distance to form a gap 122. The foregoing plates all define a first feed path for the tape.

Another elongate guide plate 124 extends rearwardly from beneath the severing mechanism 118 to an opposite end 126. The lower guide wall 112 of the intermediate guide portion 110 also has an end 128 located adjacent to the end 126 of the guide plate 124. A pair of feed rollers 130 and 132 are mounted on shafts 134 and 136 respectively.

On the opposite side of the feed rollers 130 and 132 is a tape deflector having closely spaced apart upper and lower guide plates 138 and 140 which are suitably connected together to form an integral unit which is fixedly mounted on shaft 142. The deflector plates 138 and 140 lead to an outlet opening 144 (FIG. 1) formed in the side wall 146 of the cover. Lever 150 is suitably connected to shaft 142 and terminates upwardly in a finger button 152 which projects through a top wall 92 to allow the operator to oscillate the shaft 142 back and forth to move the deflector plates 138 and 140 between the solid lines and dotted line position seen in FIG. 4. It will be noted that with the plates in the solid line position, a cut piece of tape is directed under the deflector plate 140 and over the top of the bristles 147 of moistening device 148. If in the dotted position, the deflector plates prevent the tape from being moistened and it is sent directly to the opening 144.

The tape feeding means comprises tape feed roller 86 and idler roller 154 which is rotatably mounted on shaft 156 fixed in frame 158, which in turn is pivotally mounted on shaft 160. Coil spring 162 is wrapped around the shaft 160 so that the ends bear against the frame 158 and the upper surface of deflector plate 138 to urge the frame 158 toward the feed roller 86, and thereby pressing the idler roller 154 into firm engagement with the tape as it passes around the feed roller 86.

Another feed roller 163 is fixedly mounted on a shaft 164 which is rotatably mounted in the frame. A pair of backup idler rollers 165 are mounted on shaft 166 which is rotatably mounted in frame 168 which in turn is pivotally mounted on another shaft 170 which is mounted on the frame walls. Coil spring 172 is mounted on the shaft 170 to urge the idler roller 165 toward the feed roller 163 to provide firm driving engagement between the feed roller 163 and the tape.

It will be appreciated that the feed roller 86 and backup idler roller 158, the feed roller 163 and backup idler roller 165 are all in the first path and serve both to feed the tape and to bring it back to the point where the tape is severed. The set of feed rollers 130 and 132 are disposed in a second path for ejecting the severed piece of tape.

The severing mechanism 118 comprises a cylindrical tubular member 174. This member has a plurality of axially elongate slots through which the tape passes, both in forward and reverse movements. Slot 176 provides an entrance for the tape and a second slot 178 provides an exit. A third slot 180 is formed on the same side as slot 176 to provide an exit for the severed portion of the tape and to direct the tape into the second feed path for ejection of the tape.

A movable cutting member or knife 182 is rotatably mounted in the tubular member 174, the cutting member having a close tolerance fit within the member 174. The knife 182 has a flat surface 186 which is angled slightly and defining a sharpened edge 188 which functions as a moveable blade for cutting the tape when the cutting member 182 is rotated. When the blade moves, it not only severs the tape but depresses the leading edge of the cut piece of tape to the lower slot 180 to direct the cut piece into the second path.

The drive mechanism is implemented suitably with a DC reversing motor (not seen in these figures) as described in connection with Ser. Nos. 180,161 and 180,168, previously incorporated by reference herein. The result of the operation is that a tape is fed to the postage meter for imprinting along a first path and then the tape is reversed and the appropriate strip length is severed and the severed tape strip is ejected along the second path. The complete operation is described in this referenced application and will not be further described herein except as required for the discussion of the present invention.

As shown in FIG. 4, proximity sensor 218 is suitably mounted beneath a portion of upper guide plate 82 beneath an opening in the lower guide plate 94. This sensor is of the type that shines a beam of light on the surface of the tape which is reflected back so that the distance between the tape surface and the sensor can be determined.

Figure 5:
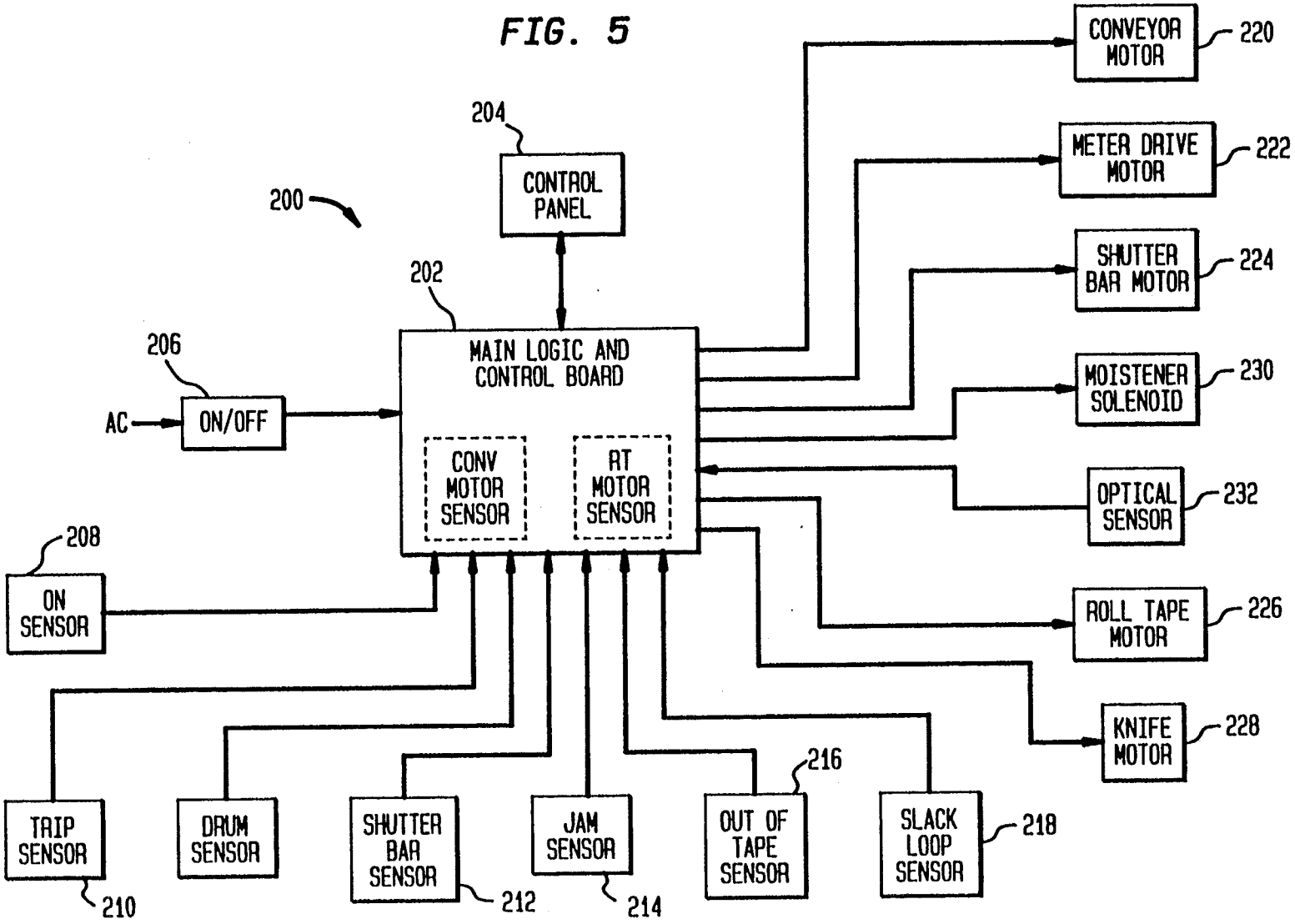
FIG. 5 is a schematic block diagram of the electronic components of the mailing machine.

FIG. 5 is a circuit block diagram of the mailing machine. As seen generally at 200, the main logic and control board 202 receives information from a control panel 204 when A/C power has been applied via on/off switch 206. Various sensors, such as those illustrated for determining the ON condition, 208; trip sensor, 210; drum sensor, 211; shutter bar sensor, 212; jam sensor, 214; out-of-tape sensor, 216; and slack loop sensor, 218 provide information to the control board 202 about the state of the machine while the board outputs information for driving the various motors and solenoids. These motors are the conveyor motor, 220; the meter drive motor, 222; the shutter bar motor, 224; the roll tape drive motor, 226; and the knife motor, 228. The board also provides control information to the moistener solenoid 230 and receives optical count data indicated here at block 232 from an optical sensor and slotted rotating disc operatively connected to the roll tape motor.

Figure 6:
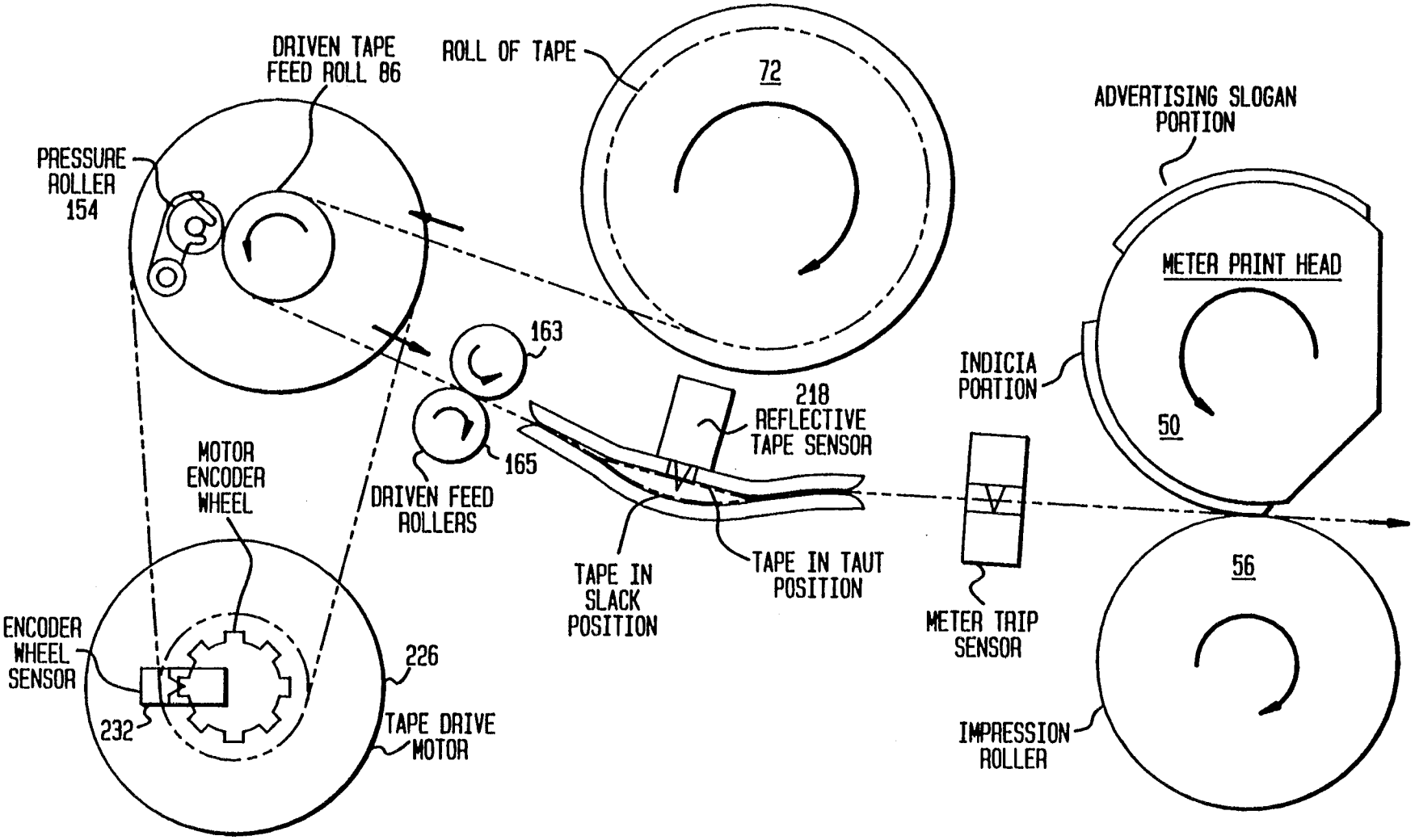
FIG. 6 is a schematic of the slack loop sensor arrangement for detection of the length of printing on the tape.
Figure 7A:
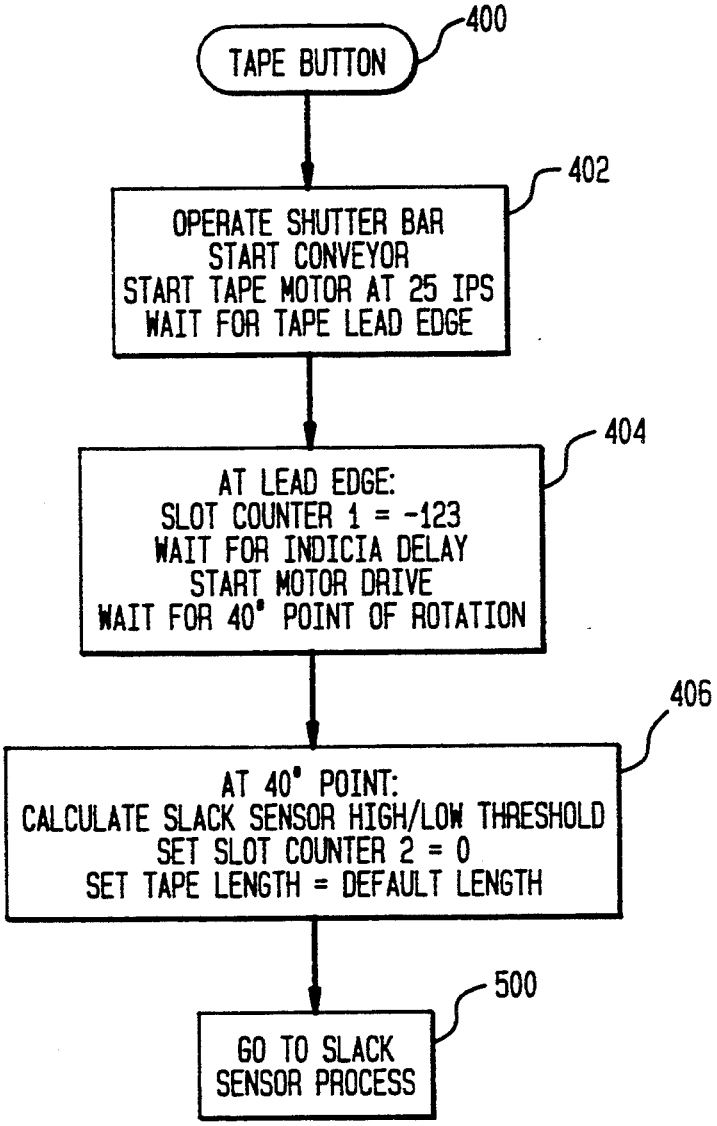
Figure 7B:
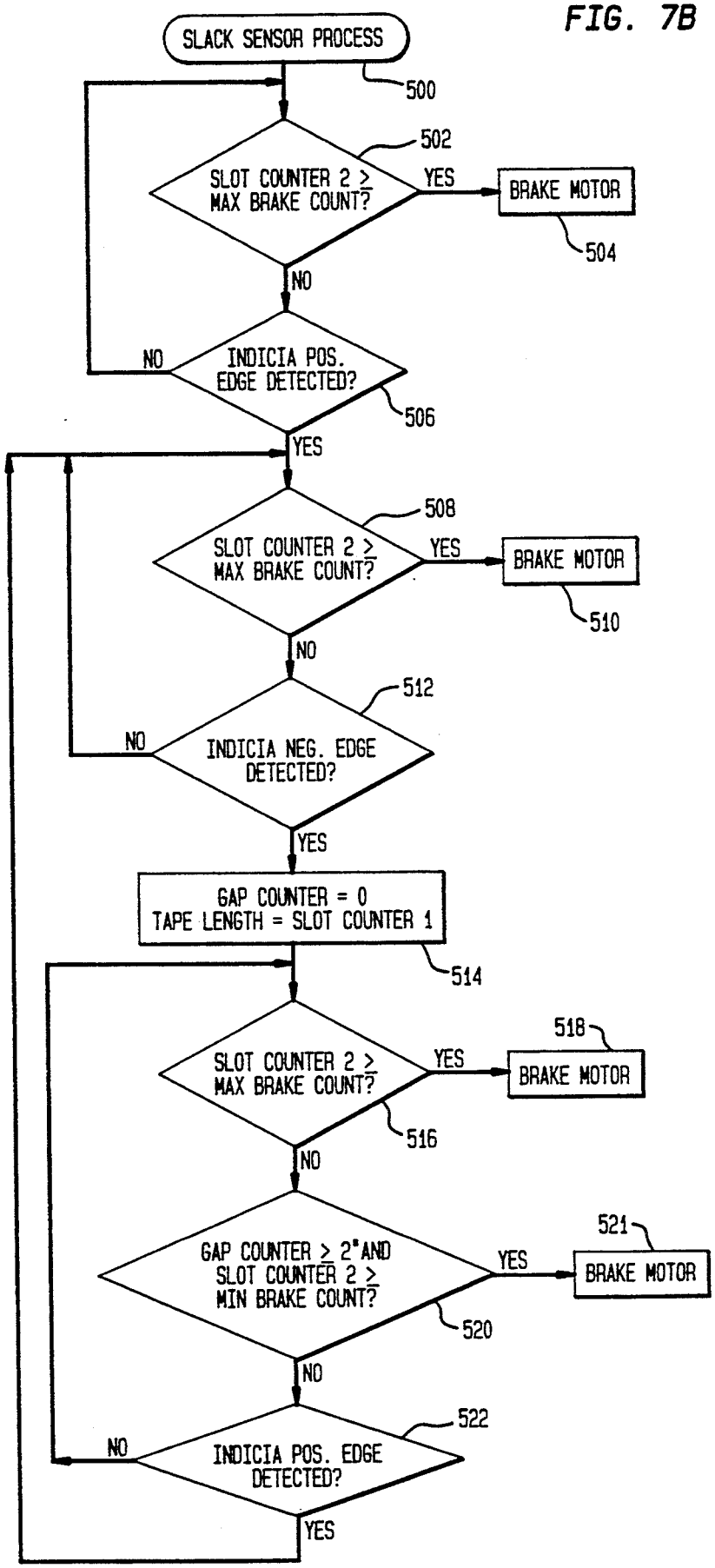

FIG. 6 is a schematic of the slack loop sensor arrangement for detection of the length of printing on the tape. The print drum contacts the tape only during printing of the indicia and ad plate. Slack loop sensor 218 is located at a point such that when the tape is pushed past it, the tape will move to the bottom of the track. The tape when pulled by the print drum during the printing operation will be pulled up against the top of the track. The speeds are deliberately slightly mismatched so that the speed of the print drum is about 5% faster than the speed of the tape. Thus as the tape is being printed it is being pulled by the meter print drum and the difference in signal from sensor 218 is used to determine the tape length based on the number of counts from the optical sensor slotted wheel combination.

FIGS. *7a* and *7b* comprise a flow chart of the operation of the routine for control of tape length in accordance with the invention. Turning to FIG. *7a*, the initiation of a print tape cycle at block 400 with operation of the tape button to operate the shutter bar, start conveyor, and start the tape motor operation, typically at about 25 ips, block 402. The program routine awaits detection of the tape lead edge at the trip sensor.

At detection, block 404, a first slot counter, slot counter 1, is set equal to −123. This counter counts the slots in the tape motor disk as they pass the associated optical sensor. It is set at −123 in order to subtract out the distance from the trip sensor to the print position. It will be understood that other slot signals and distances may be used as desired. In the preferred embodiment each slot is equivalent to approximately 0.035 inch of tape distance or in this case a total of about 4.3 inches. It will be understood from the foregoing that this slot counter provides the information as to the length of tape to be cut in terms of the slot count.

A wait state is initiated to account for the indicia delay and the motor drive is started and the 40 degree point of rotation is awaited.

At block 406 upon detection of the 40 degree rotation point, the slack sensor high/low threshold is calculated and a second slot counter, slot counter 2, is set to 0. The counter 2 is used to give a minimum and a maximum braking angle. At this point the tape length is set to a default length and the routine falls to the slack sensor process 500 illustrated in FIG. *7b*.

At block 502 slot counter 2 is checked to see if it is greater than are equal to the maximum brake count and if it has reached it the motor is braked, block 504. Preferably the maximum brake count is set at a slot count of 200 which is equivalent to approximately 300 degrees of rotation. If it has not reached the maximum a check is made, block 506, to determine whether the positive edge of the indicia is detected by the slack loop sensor.

If not the program loops back and if it has been detected, the routine falls to again check first to see whether the maximum brake count in counter 2 has been reached, block 508, and if it has been reached, the motor is braked, block 510. If slot counter 2 is less than the maximum, the routine checks at block 512 to see whether the negative edge of the indicia has been detected by the slack loop sensor. If it has not, the program loops back, but when the negative edge is detected, the routine falls to block 514 where a gap counter is set to 0 and the tape length is set equal to the value of the slot counter 1. This timer prevents braking until approximately 2 inches after the most recent trailing edge, unless overridden by the maximum braking angle setting. This counter prevents the change in signal from the slack loop signal because of the gap between the indicia plate and the ad plate from triggering an unwanted braking of the motor before the ad plate has been printed.

For best results, it has been found that the tape motor speed should be increased, e.g. to 26 ips, upon detection of the positive edge and reduced again to its original value on detection of the negative edge.

The value in slot counter 2 is again checked, block 516, to see if it has reached the maximum brake count and if it has the motor is braked, block 518. If not the routine falls to block 520 to determine if both the gap counter is greater than the equivalent of 2 inches and whether slot counter 2 is greater than or equal to the minimum brake count, suitably 105 slots or approximately 180 degrees, and if both conditions are met the motor is braked, block 520.

If both conditions are not met the routine continues to block 522 to determine whether the positive edge of the slack loop sensor signal due to the ad plate has been detected and if not the program loops back to block 516. If it is detected the program loops back to block 508 to await the detection of the negative edge of the ad plate.

FIG. 8 is a timing plot of the previously described signals showing the timing of a tape cycle without the ad plate being printed and FIG. 9 shows the timing with the ad plate printing.

What is claimed is:

1. A mailing machine for printing a postage indicia with or without an advertisement on envelopes and varying lengths of postage tape, comprising:

an elongate feed deck;

a postage meter mounted in the mailing machine and having a printer downstream of said feed deck for printing a postage indicia with or without an advertisement on successive envelopes as they are fed along said feed deck or on postage tape; and a tape feeding and cutting apparatus mounted in said mailing machine for feeding postage tape to the postage meter for printing of said postage indicia with or without advertisement and for cutting said postage tape into finite lengths and ejecting said lengths of tape from said mailing machine, said tape feeding and cutting apparatus including A. means for storing a supply roll of tape of indefinite length, B. means for feeding said tape from said tape supply roll to the postage meter printer for printing of said postage indicia with or without advertisement on a portion of said tape, C. means for sensing when said postage meter printer has completed printing said postage indicia with or without advertisement on said portion of said tape and for determining an amount of tape being printed with said postage indicia, D. means for retracting said amount of tape from said postage meter printer as determined by said sensing means which will result in an appropriate, finite length of tape being cut by the tape feeding and cutting apparatus, E. means for cutting said finite length of tape having the postage indicia printed thereon from said supply roll of tape, and F. means for ejecting said cut, printed finite length of tape from said mailing machine, whereby said cut, printed finite length of tape includes only the amount of tape necessary for the printing of said indicia with or without advertisement regardless of the length of any advertisement printed.

2. The apparatus of claim 1, wherein said sensing means includes a sensor for sensing the amount of slack in the tape at a location adjacent and upstream of said postage meter.

3. The apparatus of claim 2, wherein said retracting means retracts said tape from said postage meter in a direction substantially opposite the direction of feeding to the postage meter.

4. The apparatus of claim 2, wherein said tape feeding means includes a tape track having an upper portion and a lower portion.

5. The apparatus of claim 4, wherein said sensor is located above said upper tape track portion and wherein maximum slack is registered when said tape is in contact with said lower tape track portion to thereby signal completion of the printing of said postage indicia with or without advertisement.

6. A method of feeding, printing and cutting a roll of postage tape in a mailing machine having a postage meter for printing postage indicia on the postage tape, a sensor, a postage tape retracting device, and a postage tape cutting device, the method comprising the steps of:

feeding the postage tape along a first path toward the postage meter;

printing postage indicia with or without an advertisement on a portion of said tape;

sensing when the printing of the indicia with or without advertisement has been completed;

determining an amount of tape being printed with the postage indicia;

retracting said amount of tape from the postage meter based upon the result of the sensing and determining steps;

cutting an appropriate finite length of printed tape corresponding to the amount of tape being printed; and ejecting said finite length of cut, printed tape from the mailing machine whereby said finite length of cut, printed tape includes only the amount of tape necessary for the printing of said indicia with or without advertisement regardless of the length of any advertisement printed.

7. The method of claim 6, wherein the sensing includes sensing the amount of slack in the tape at a location adjacent and upstream of the printing.

8. The method of claim 7, additionally comprising ejecting said finite length of cut, printed tape along a second path substantially opposite the first path.

* * * * *